US007708655B2

(12) United States Patent
Kasashima et al.

(10) Patent No.: US 7,708,655 B2
(45) Date of Patent: May 4, 2010

(54) GOLF BALL

(75) Inventors: Atsuki Kasashima, Chichibu (JP); Atsushi Komatsu, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 12/132,247

(22) Filed: Jun. 3, 2008

(65) Prior Publication Data

US 2009/0209368 A1 Aug. 20, 2009

Related U.S. Application Data

(63) Continuation-in-part of application No. 12/033,466, filed on Feb. 19, 2008.

(51) Int. Cl.
*A63B 37/06* (2006.01)

(52) U.S. Cl. ..... 473/373

(58) Field of Classification Search ..... 473/373, 473/374, 368, 367

See application file for complete search history.

(56) References Cited

U.S. PATENT DOCUMENTS

| | | | | |
|---|---|---|---|---|
| 6,565,455 | B2 * | 5/2003 | Hayashi et al. | 473/371 |
| 6,592,470 | B2 | 7/2003 | Watanabe et al. | |
| 6,656,059 | B2 | 12/2003 | Umezawa et al. | |
| 6,723,008 | B2 | 4/2004 | Higuchi et al. | |
| 6,923,735 | B1 * | 8/2005 | Hayashi | 473/376 |
| 7,084,198 | B2 | 8/2006 | Takesue et al. | |
| 7,270,612 | B2 | 9/2007 | Hayashi | |
| 7,270,613 | B2 | 9/2007 | Hayashi | |
| 7,288,031 | B2 | 10/2007 | Watanabe et al. | |

FOREIGN PATENT DOCUMENTS

| | | | |
|---|---|---|---|
| JP | 2001-218873 | A | 8/2001 |
| JP | 2002-85589 | A | 3/2002 |
| JP | 2002-315848 | A | 10/2002 |
| JP | 2002-345999 | A | 12/2002 |
| JP | 2003-175129 | A | 6/2003 |
| JP | 2005-211656 | A | 8/2005 |
| JP | 2005-218858 | A | 8/2005 |
| JP | 2005-218859 | A | 8/2005 |
| JP | 2005-342532 | A | 12/2005 |
| JP | 2006-87948 | A | 4/2006 |
| JP | 2006-87949 | A | 4/2006 |
| JP | 2006-230661 | A | 9/2006 |

* cited by examiner

*Primary Examiner*—Raeann Trimiew
(74) *Attorney, Agent, or Firm*—Sughrue Mion, PLLC

(57) ABSTRACT

The invention provides a golf ball composed of a core, a cover having a plurality of dimples on an outside surface thereof, and an intermediate layer disposed between the core and the cover. The intermediate layer is formed of a highly neutralized resin material, and has a Shore D hardness below 50 and a thickness of at least 1.7 mm but not more than 6.0 mm. The cover and the intermediate layer have a difference in Shore D hardness therebetween (cover Shore D hardness−intermediate layer Shore D hardness) of from 13 to 35. The cover and the intermediate layer have a combined thickness greater than 3 mm. The ball as a whole has a deflection, when compressed under a final load of 130 kgf from an initial load of 10 kgf, of at least about 2.0 mm but not more than about 4.0 mm. The golf ball, through a combination of dimples which do not cause a loss of lift in the low-velocity, low-spin rate region of the ball trajectory and a low-spin construction, travels farther and is therefore beneficial for competitive use by both skilled and amateur golfers.

21 Claims, 2 Drawing Sheets

GOLF BALL

CROSS-REFERENCE TO RELATED APPLICATION

This application is a continuation-in-part of copending application Ser. No. 12/033,466 filed on Feb. 19, 2008, the contents of which are hereby incorporated by reference.

BACKGROUND OF THE INVENTION

The present invention relates to a golf ball composed of a core, an intermediate layer and a cover having a plurality of dimples formed thereon. More specifically, the invention relates to a golf ball which, in terms of distance and other properties, is beneficial for competitive use by highly skilled golfers and amateur golfers.

It is known that a golf ball, when hit at a low spin rate and a high launch angle, will travel a longer distance. With recent advances in golfing gear (balls and clubs), it is no longer unusual for a ball to be hit under exceedingly low spin conditions such as a backspin of 2,000 rpm. Under such low spin conditions, the ball has a low coefficient of drag (CD), which works to increase the distance of travel. However, with conventional dimples, in the low-velocity region after the ball has passed through the highest point of its trajectory, a loss of distance occurs due to insufficient lift and the resulting drop in trajectory.

Recently, golf balls often have an internal construction with a plurality of layers. The layers enclosing the core of a ball typically include a cover and an intermediate layer situated between the core and the cover. Numerous disclosures have been made in the art relating to the use of materials for forming such an intermediate layer which are based on highly neutralized polymers (see the ten patent documents listed below).

JP-A 2006-087949
JP-A 2006-087948
JP-A 2005-342532
JP-A 2005-218859
JP-A 2005-218858
JP-A 2003-175129
JP-A 2002-345999
JP-A 2002-315848
JP-A 2002-085589
JP-A 2001-218873

However, in these golf balls, the rebound sometimes decreases on account of the cover material which encloses the intermediate layer. Hence, there remains room for further improvement in the distance traveled by the ball.

In addition, the patent documents listed below relate to golf balls in which a sphere composed of a core encased by an intermediate layer has an improved deflection or initial velocity, although there remains room for improvement in the distance traveled by such balls.

JP-A 2006-230661
JP-A 2005-211656

SUMMARY OF THE INVENTION

It is therefore an object of the present invention to provide a golf ball which has an improved rebound and sufficiently reduces the spin rate on shots with a driver, thus increasing the distance of travel.

The inventor, on conducting extensive investigations aimed at achieving the above object, has discovered the surprising and unanticipated fact that, in a golf ball composed of a core encased by an intermediate layer and a cover, by using a highly neutralized polymer having a high resilience as the intermediate layer-forming material in order to maintain the rebound of the overall ball and by also setting the hardnesses and thicknesses of the cover and the intermediate layer in specific ranges, owing to synergistic effects between the intermediate layer and the cover, the rebound of the overall ball can be kept from decreasing, enabling the distance traveled by the ball to be increased. The inventor has also found that, when a dimple design which does not lose lift in the low-velocity, low-spin region of the ball trajectory is provided on the outside surface of a golf ball having the foregoing core/intermediate layer/cover construction at the interior, the ball structure which achieves a low spin rate on shots with a driver and the improved lift on the ball trajectory together enable the ball to travel a longer distance.

Accordingly, the invention provides the following golf balls.

[1] A golf ball comprising a core, a cover having a plurality of dimples on an outside surface thereof, and an intermediate layer disposed between the core and the cover, wherein the intermediate layer is formed of a material composed primarily of a heated mixture of:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) from about 15 to about 150 parts by weight of a fatty acid and/or fatty acid derivative having a molecular weight of from 228 to 1500; and (d) from about 0.1 to about 17 parts by weight of a basic inorganic metal compound capable of neutralizing un-neutralized acid groups in the base resin and component (c);

the intermediate layer has a Shore D hardness of less than about 50 and a thickness of at least about 1.7 mm but not more than about 6.0 mm; the cover and the intermediate layer have a difference in Shore D hardness therebetween (cover Shore D hardness−intermediate layer Shore D hardness) of from about 13 to about 35; the cover and the intermediate layer have a combined thickness greater than about 3 mm; and the ball as a whole has a deflection, when compressed under a final load of 130 kgf from an initial load of 10 kgf, of at least about 2.0 mm but not more than about 4.0 mm.

[2] The golf ball of claim 1, wherein the number of dimples is from about 250 to about 350, and the dimples have a total volume of from about 400 $mm^3$ to about 750 $mm^3$.

BRIEF DESCRIPTION OF THE DIAGRAMS

DETAILED DESCRIPTION OF THE INVENTION

The invention is described more fully below.

Figure 1:
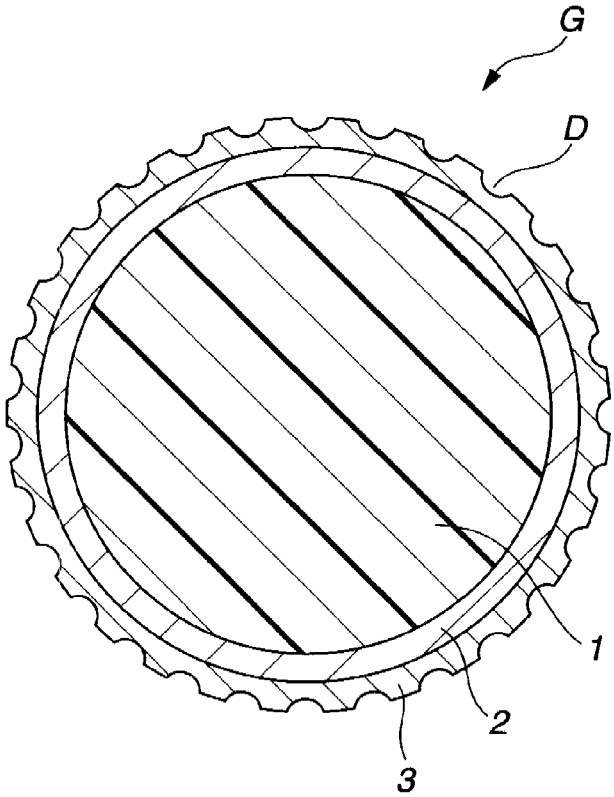
FIG. 1 is a schematic cross-sectional view showing the internal construction of a golf ball according to one embodiment of the invention.

As noted above, the present invention pertains to a golf ball having a core, a cover, and an intermediate layer situated between the core and the cover. The surface of the ball has a plurality of dimples thereon. As an embodiment of the inventive ball, FIG. 1 shows a multi-piece solid golf ball G having a core 1, a cover 3 with a plurality of dimples D thereon, and an intermediate layer 2 situated between the core 1 and the cover 3.

The core-forming material may be a rubber composition composed primarily of polybutadiene and including suitable amounts of various additives, such as an organic peroxide, an antioxidant, an inorganic filler, and an unsaturated carboxylic acid and/or a metal salt thereof. The rubber composition may be molded and vulcanized to form a crosslinked rubber material as the core, such vulcanization being carried out under conditions and by a method in general accordance with commonly known conditions and methods used for the same purpose.

The core has a diameter which, while not subject to any particular limitation, is preferably at least about 30 but not more than about 38.5 mm in cases where a three-piece golf ball is to be formed.

The core has a deflection, when compressed under a final load of 130 kgf from an initial load of 10 kgf, of preferably at least about 3.0 mm, more preferably at least about 3.3 mm, and even more preferably at least about 3.5 mm. The upper limit of such deflection is preferably not more than about 5.0 mm, more preferably not more than about 4.8 mm, and even more preferably not more than about 4.3 mm.

The core has a surface hardness which, while not subject to any particular limitation, has a JIS-C hardness value of preferably at least about 60, more preferably at least about 65, and even more preferably at least about 70, but preferably not more than about 85, and more preferably not more than about 80. The core has a center hardness which, while not subject to any particular limitation, has a JIS-C hardness value of preferably at least about 50, and more preferably at least about 55, but preferably not more than about 65, and more preferably not more than about 62. The difference therebetween (core surface hardness−core center hardness), in terms of JIS-C hardness, is preferably at least about 5 but not more than about 30, and more preferably at least about 10 but not more than about 25. By setting the core hardness distribution (hardness difference) in the foregoing ranges, an even greater reduction in the spin rate can be achieved.

The intermediate layer is disposed between the core and the subsequently described cover. By using a material having a good resilience and finishing to a laminate of relatively high thickness, it is possible to sufficiently lower the spin rate of the ball, enabling the objects of the invention to be achieved. The intermediate layer is not limited to a single layer, and may instead be formed as a plurality of layers.

The intermediate layer is formed of a material composed primarily of a heated mixture of:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) from about 15 to about 150 parts by weight of a fatty acid and/or fatty acid derivative having a molecular weight of from 228 to 1500; and (d) from about 0.1 to about 17 parts by weight of a basic inorganic metal compound capable of neutralizing un-neutralized acid groups in the base resin and component (c).

In the present invention, by using the above material to form the intermediate layer, the spin rate on shots with a W#1 can be lowered, enabling the ball to travel a longer distance.

The phrase "composed primarily of a heated mixture" signifies that the heated mixture accounts for at least about 50 wt %, preferably at least about 60 wt %, and more preferably at least about 70 wt %, of the overall weight of the intermediate layer.

The olefin in the above base resin, whether in component (a) or component (b), has a number of carbons which is preferably at least 2 but not more than 8, and more preferably not more than 6. Specific examples include ethylene, propylene, butene, pentene, hexene, heptene and octene. Ethylene is especially preferred.

Examples of unsaturated carboxylic acids include acrylic acid, methacrylic acid, maleic acid and fumaric acid. Acrylic acid and methacrylic acid are especially preferred.

Moreover, the unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The olefin-unsaturated carboxylic acid random copolymer of component (a) and the olefin-unsaturated carboxylic acid-unsaturated carboxylic acid ester random terpolymer of component (b) (the copolymers in components (a) and (b) are referred to collectively below as "random copolymers") may each be obtained by preparing the above-mentioned materials and carrying out random copolymerization by a known method.

It is recommended that the above random copolymers have unsaturated carboxylic acid contents (acid contents) that are controlled. Here, it is recommended that the content of unsaturated carboxylic acid present in the random copolymer serving as component (a) be at least about 4 wt %, preferably at least about 6 wt %, more preferably at least about 8 wt %, and even more preferably at least about 10 wt %, but generally not more than about 30 wt %, preferably not more than about 20 wt %, more preferably not more than about 18 wt %, and even more preferably not more than about 15 wt %.

Similarly, it is recommended that the content of unsaturated carboxylic acid present in the random copolymer serving as component (b) be generally at least about 4 wt %, preferably at least about 6 wt %, and more preferably at least about 8 wt %, but generally not more than about 15 wt %, preferably not more than about 12 wt %, and more preferably not more than about 10 wt %. If the acid content of the random copolymer is too low, the resilience may decrease, whereas if it is too high, the proccessability of the intermediate layer-forming resin material may decrease.

The metal ion neutralization product of the olefin-unsaturated carboxylic acid random copolymer of component (a) and the metal ion neutralization product of the olefin-unsaturated carboxylic acid-unsaturated carboxylic acid ester random terpolymer of component (b) (the metal ion neutralization products of the copolymers in components (a) and (b) are referred to collectively below as "metal ion neutralization products of the random copolymers") may be obtained by neutralizing some of the acid groups on the random copolymers with metal ions.

Illustrative examples of metal ions for neutralizing the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, preferred use can be made of, for example, $Na^+$, $Li^+$, $Zn^{++}$ and $Mg^{++}$. To improve resilience, the use of $Na^+$ is even more preferred.

The above metal ion neutralization products of the random copolymers may be obtained by neutralizing the random copolymers with the foregoing metal ions. For example, use may be made of a method in which neutralization is carried out with a compound such as a formate, acetate, nitrate, carbonate, bicarbonate, oxide, hydroxide or alkoxide of the above-mentioned metal ions. No particular limitation is imposed on the degree of neutralization of the random copolymer by these metal ions.

Sodium ion-neutralized ionomer resins may be suitably used as the above metal ion neutralization products of random copolymers to increase the melt flow rate of the material. In this way, adjustment of the material to the subsequently described optimal melt flow rate is easy, enabling the moldability to be improved.

Commercially available products may be used as the base resins of above components (a) and (b). Illustrative examples of the random copolymer in component (a) include Nucrel 1560, Nucrel 1214 and Nucrel 1035 (all products of DuPont-Mitsui Polychemicals Co., Ltd.), and Escor 5200, Escor 5100 and Escor 5000 (all products of ExxonMobil Chemical). Illustrative examples of the random copolymer in component (b) include Nucrel AN4311 and Nucrel AN4318 (both products of DuPont-Mitsui Polychemicals Co., Ltd.), and Escor ATX325, Escor ATX320 and Escor ATX310 (all products of ExxonMobil Chemical).

Illustrative examples of the metal ion neutralization product of the random copolymer in component (a) include Himilan 1554, Himilan 1557, Himilan 1601, Himilan 1605, Himilan 1706 and Himilan AM7311 (all products of DuPont-Mitsui Polychemicals Co., Ltd.), Surlyn 7930 (E.I. DuPont de Nemours & Co.), and Iotek 3110 and Iotek 4200 (both products of ExxonMobil Chemical). Illustrative examples of the metal ion neutralization product of the random copolymer in component (b) include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. DuPont de Nemours & Co.), and Iotek 7510 and Iotek 7520 (both products of ExxonMobil Chemical). Sodium-neutralized ionomer resins that are suitable as the metal ion neutralization product of the random copolymer include Himilan 1605, Himilan 1601 and Himilan 1555.

When preparing the above-described base resin, component (a) and component (b) are admixed in a weight ratio of between 100:0 and 0:100, preferably between 100:0 and 25:75, more preferably between 100:0 and 50:50, even more preferably between 100:0 and 75:25, and most preferably 100:0. If too little component (a) is included, the molded material obtained therefrom may have a decreased resilience.

In addition, the proccessability of the base resin can be further improved by also adjusting the ratio in which the random copolymers and the metal ion neutralization products of the random copolymers are admixed when preparing the base resin as described above. It is recommended that the weight ratio of the random copolymers to the metal ion neutralization products of the random copolymers be generally between 0:100 and 60:40, preferably between 0:100 and 40:60, more preferably between 0:100 and 20:80, and even more preferably 0:100. The addition of too much random copolymer may lower the proccessability during mixing.

Component (e) described below may be added to the base resin. Component (e) is a non-ionomeric thermoplastic elastomer. The purpose of this component is to further improve both the feel of the ball on impact and the rebound. Examples include olefin elastomers, styrene elastomers, polyester elastomers, urethane elastomers and polyamide elastomers. To further increase the rebound, it is preferable to use a polyester elastomer or an olefin elastomer. The use of an olefin elastomer composed of a thermoplastic block copolymer which includes crystalline polyethylene blocks as the hard segments is especially preferred.

A commercially available product may be used as component (e). Illustrative examples include Dynaron (JSR Corporation) and the polyester elastomer Hytrel (DuPont-Toray Co., Ltd.).

It is recommended that component (e) be included in an amount, per 100 parts by weight of the base resin of the invention, of preferably at least 0 part by weight, more preferably at least about 5 parts by weight, even more preferably at least about 10 parts by weight, and most preferably at least about 20 parts by weight, but preferably not more than about 100 parts by weight, more preferably not more than about 60 parts by weight, even more preferably not more than about 50 parts by weight, and most preferably not more than about 40 parts by weight. Too much component (e) will lower the compatibility of the mixture, possibly resulting in a substantial decline in the durability of the golf ball.

Next, component (c) described below may be added to the base resin. Component (c) is a fatty acid or fatty acid derivative having a molecular weight of at least 228 but not more than 1500. Compared with the base resin, this component has a very low molecular weight and, by suitably adjusting the melt viscosity of the mixture, helps in particular to improve the flow properties. Component (c) includes a relatively high content of acid groups (or derivatives thereof), and is capable of suppressing an excessive loss in resilience.

The fatty acid or fatty acid derivative of component (c) has a molecular weight of at least 228, preferably at least 256, more preferably at least 280, and even more preferably at least 300, but not more than 1500, preferably not more than 1000, even more preferably not more than 600, and most preferably not more than 500. If the molecular weight is too low, the heat resistance cannot be improved. On the other hand, if the molecular weight is too high, the flow properties cannot be improved.

The fatty acid or fatty acid derivative of component (c) may be an unsaturated fatty acid (or derivative thereof) containing a double bond or triple bond on the alkyl moiety, or it may be a saturated fatty acid (or derivative thereof) in which the bonds on the alkyl moiety are all single bonds. It is recommended that the number of carbons on the molecule be preferably at least 18, more preferably at least 20, even more preferably at least 22, and most preferably at least 24, but preferably not more than 80, more preferably not more than 60, even more preferably not more than 40, and most preferably not more than 30. Too few carbons may make it impossible to improve the heat resistance and may also make the acid group content so high as to diminish the flow-improving effect due to interactions with acid groups present in the base resin. On the other hand, too many carbons increases the molecular weight, which may not represent flow-improving effect from appearing remarkably.

Specific examples of the fatty acid of component (c) include myristic acid, palmitic acid, stearic acid, 12-hydroxystearic acid, behenic acid, oleic acid, linoleic acid, linolenic acid, arachidic acid and lignoceric acid. Of these, stearic acid, arachidic acid, behenic acid and lignoceric acid are preferred. Behenic acid is especially preferred.

The fatty acid derivative of component (c) is exemplified by metallic soaps in which the proton on the acid group of the fatty acid has been replaced with a metal ion. Examples of the metal ion include $Na^{+}$, $Li^{+}$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (c) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Component (d) may be added as a basic inorganic metal compound capable of neutralizing acid groups in the base resin and in component (c). If component (d) is not included, when a metal soap-modified ionomer resin (e.g., the metal soap-modified ionomer resins mentioned in the above-cited patent publications) is used alone, the metallic soap and un-neutralized acid groups present on the ionomer resin undergo exchange reactions during mixture under heating, generating a large amount of fatty acid. Because the fatty acid has a low thermal stability and readily vaporizes during molding, it may cause molding defects. Moreover, if the fatty acid thus generated deposits on the surface of the molded material, it may substantially lower paint film adhesion and may have other undesirable effects such as lowering the resilience of the resulting molded material.

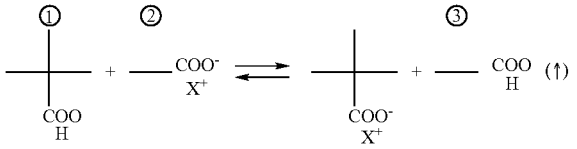

(1) un-neutralized acid group present on the ionomer resin
(2) metallic soap
(3) fatty acid
X: metal cation Accordingly, to solve this problem, the intermediate layer-forming resin material includes also, as an essential component, a basic inorganic metal compound (d) which neutralizes the acid groups present in the base resin and component (c), in this way improving the resilience of the molded material.

That is, by including component (d) as an essential ingredient in the material, not only are the acid groups in the base resin and component (c) neutralized, through synergistic effects from the optimal addition of each of these components it is possible as well to increase the thermal stability of the mixture and give it a good moldability, and also to enhance the resilience.

Here, it is recommended that the basic inorganic metal compound used as component (d) be a compound which has a high reactivity with the base resin and contains no organic acids in the reaction by-products, thus enabling the degree of neutralization of the mixture to be increased without a loss of thermal stability.

Illustrative examples of the metal ion in the basic inorganic metal compound serving as component (d) include $Li^{+}$, $Na^{+}$, $K^{+}$, $Ca^{++}$, $Mg^{++}$, $Zn^{++}$, $Al^{+++}$, $Ni^{++}$, $Fe^{++}$, $Fe^{+++}$, $Cu^{++}$, $Mn^{++}$, $Sn^{++}$, $Pb^{++}$ and $Co^{++}$. Known basic inorganic fillers containing these metal ions may be used as the basic inorganic metal compound. Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. In particular, a hydroxide or a monoxide is recommended. Calcium hydroxide and magnesium oxide, which have a high reactivity with the base resin, are more preferred. Calcium hydroxide is especially preferred.

Because the above-described resin material is arrived at by blending specific respective amounts of components (c) and (d) with the resin component, i.e., the base resin containing specific respective amounts of components (a) and (b) in combination with optional component (e), this material has excellent thermal stability, flow properties and moldability, and can impart the molded material with a markedly improved resilience.

Components (c) and (d) are included in respective amounts, per 100 parts by weight of the resin component suitably formulated from components (a), (b) and (e), of at least about 15 parts by weight, preferably at least about 40 parts by weight, more preferably at least about 81 parts by weight, even more preferably at least about 90 parts, and most preferably at least about 95 parts by weight, but not more than about 150 parts by weight, preferably not more than about 130 parts by weight, and more preferably not more than about 120 parts by weight, of component (c); and at least about 0.1 part by weight, preferably at least about 0.5 part by weight, more preferably at least about 1 part by weight, and even more preferably at least about 2 parts by weight, but not more than about 17 parts by weight, preferably not more than about 15 parts by weight, more preferably not more than about 13 parts by weight, and even more preferably not more than about 10 parts by weight, of component (d). Too little component (c) lowers the melt viscosity, resulting in inferior proccessability, whereas too much lowers the durability. Too little component (d) fails to improve thermal stability and resilience, whereas too much instead lowers the heat resistance of the golf ball-forming material due to the presence of excess basic inorganic metal compound.

In the above-described resin material formulated from the respective above-indicated amounts of the resin component and components (c) and (d), it is recommended that at least 70 mol %, preferably at least 90 mol %, more preferably at least 96 mol %, and even more preferably at least 100 mol %, of the acid groups be neutralized. Such a high degree of neutralization makes it possible to more reliably suppress the exchange reactions that cause trouble when only a base resin and a fatty acid or fatty acid derivative are used in the above-cited prior art, thus preventing the generation of fatty acid. As a result, there is obtained a resin material of substantially improved thermal stability and good proccessability which can provide molded products of much better resilience than prior-art ionomer resins.

"Degree of neutralization," as used above, refers to the degree of neutralization of acid groups present within the mixture of the base resin and the fatty acid or fatty acid derivative serving as component (c), and differs from the degree of neutralization of the ionomer resin itself when an ionomer resin is used as the metal ion neutralization product of a random copolymer in the base resin. A mixture according to the invention having a certain degree of neutralization, when compared with an ionomer resin alone having the same degree of neutralization, contains a very large number of metal ions. This large number of metal ions increases the density of ionic crosslinks which contribute to improved resilience, making it possible to confer the molded product with excellent resilience.

To more reliably achieve both a high degree of neutralization and good flow properties, use may be made of a material in which the acid groups in the above-described mixture have been neutralized with transition metal ions and with alkali metal and/or alkaline earth metal ions. Although neutralization with transition metal ions results in a weaker ionic cohesion than neutralization with alkali metal and alkaline earth metal ions, by using these different types of ions together to neutralize acid groups in the mixture, a substantial improvement can be made in the flow properties.

It is recommended that the molar ratio between the transition metal ions and the alkali metal and/or alkaline earth metal ions be in a range of typically 10:90 to 90:10, preferably 20:80 to 80:20, more preferably 30:70 to 70:30, and even more preferably 40:60 to 60:40. Too low a molar ratio of transition metal ions may fail to provide a sufficient flow-improving effect. On the other hand, a transition metal ion molar ratio which is too high may lower the resilience.

Examples of the metal ions include, but are not particularly limited to, zinc ions as the transition metal ions and at least one type of ion selected from among sodium, lithium and magnesium ions as the alkali metal or alkaline earth metal ions.

A known method may be used to obtain a mixture in which the desired amount of acid groups have been neutralized with transition metal ions and alkali metal or alkaline earth metal ions. Specific examples of methods of neutralization with transition metal ions, particularly zinc ions, include a method which uses a zinc soap as the fatty acid derivative, a method which uses a zinc ion neutralization product (e.g., a zinc ion-neutralized ionomer resin) when formulating components (a) and (b) as the base resin, and a method which uses a zinc compound such as zinc oxide as the basic inorganic metal compound of component (d).

The resin material should preferably have a melt flow rate adjusted to ensure flow properties that are particularly suitable for injection molding, and thus improve moldability. Specifically, it is recommended that the melt flow rate (MFR), as measured according to JIS-K7210 at a temperature of 190° C. and under a load of 21.18 N (2.16 kgf), be set to preferably at least 0.5 dg/min, more preferably at least 0.7 dg/min, even more preferably at least 0.8 dg/min, and most preferably at least 2 dg/min, but preferably not more than 20 dg/min, more preferably not more than 10 dg/min, even more preferably not more than 5 dg/min, and most preferably not more than 3 dg/min. Too high or low a melt flow rate may result in a substantial decline in proccessability.

Illustrative examples of the intermediate layer material include those having the trade names HPF 1000, HPF 2000, HPF AD1027, HPF AD1035 and HPF AD1040, as well as the experimental material HPF SEP1264-3, all produced by DuPont.

The intermediate layer must have a Shore D hardness of not more than about 50, and preferably not more than about 46. The lower limit is preferably at least about 30, and more preferably at least about 35. At a Shore D value outside of the above hardness range for the intermediate layer, the spin rate of the ball tends to increase, as a result of which the distance traveled by the ball may decrease.

The intermediate layer has a thickness of at least about 1.7 mm, and preferably at least about 2.1 mm. The upper limit is not more than about 6.0 mm, preferably not more than about 5.5 mm, and more preferably not more than about 5.0 mm. By thus providing the intermediate layer with a sufficient thickness, a sphere having the intermediate layer is able to manifest a sufficient degree of resilience, in addition to which the spin rate of the ball is suppressed, enabling the distance traveled by the ball to be increased. If the intermediate layer is given too large a thickness, short molding of the resin material tends to arise, which is undesirable.

A sphere composed of the core encased by the intermediate layer has a deflection, when compressed under a final load of 130 kgf from an initial load of 10 kgf, which, while not subject to any particular limitation, is preferably at least about 2.5 mm, and more preferably at least about 3.0 mm, but preferably not more than about 4.0 mm, and even more preferably not more than about 3.6 mm.

When the intermediate layer is formed of the above-described heated mixture, the cover in the invention may be formed of a known material. For example, a thermoplastic resin may be used for this purpose.

Other exemplary cover materials include ionomer resins and thermoplastic elastomers. For example, use can be made of polyester-type thermoplastic elastomers, polyamide-type thermoplastic elastomers, polyurethane-type thermoplastic elastomers, olefin-type thermoplastic elastomers and styrene-type thermoplastic elastomers. Of these, ionomer resins and polyurethane-type thermoplastic elastomers are preferred. Examples of commercial ionomer resins and the like that may be used include Himilan (DuPont-Mitsui Polychemicals), Surlyn (DuPont), Iotek (Exxon Corporation) and T-8190 (Dainippon Ink & Chemicals).

The cover has a Shore D hardness of preferably at least about 59, and more preferably at least about 61, but preferably not more than about 70, and more preferably not more than about 68. If the cover is too soft, it may not be possible to lower the spin rate. On the other hand, if the cover is too hard, the feel on impact with the putter tends to worsen.

In the invention, the cover and the intermediate layer have a difference in Shore D hardness therebetween (cover Shore D hardness—intermediate layer Shore D hardness) with a lower limit of at least about 13, and preferably at least about 15. The upper limit is not more than about 35, and preferably not more than about 30. By adjusting the hardness relationship between the cover and the intermediate layer in this way, it is possible to lower the spin rate by the ball as a whole on shots with a driver, and thus enable the ball to travel farther.

It is recommended that the cover in the invention have a thickness of at least about 0.3 mm, preferably at least about 0.5 mm, and more preferably at least about 0.7 mm, but not more than about 3.0 mm, preferably not more than about 2.5 mm, and more preferably not more than about 2.3 mm. If the cover is too thin, the durability may worsen and cracking tends to arise. On the other hand, if the cover is too thick, the ball may have a poor feel on impact.

It is essential for the cover and the intermediate layer to have a combined thickness higher than about 3.0 mm, preferably at least about 3.2 mm, and more preferably at least about 3.5 mm. The purpose is to fully enable a sufficient reduction in the spin rate of the ball, and also to take full advantage of the resilience of the intermediate layer material.

As is the case with methods of molding covers for conventional golf balls, any of various known methods, such as injection molding or compression molding, may be used to form the above-described intermediate layer and cover. The intermediate layer and cover may be easily formed by suitably selecting conditions such as the injection temperature and time from commonly used ranges.

In the present invention, the number of dimples formed on the surface of the ball, while not subject to any particular limitation, is preferably at least about 250, more preferably at least about 272, even more preferably at least about 296, and most preferably at least about 316, but preferably not more than about 350, more preferably not more than about 348, even more preferably not more than about 342, and most preferably not more than about 336. By setting the number of dimples within this range, a high lift is achieved on the ball trajectory, enabling the ball to travel a longer distance. Although the number of dimples on the inventive golf ball is set to a relatively small number compared with the number of dimples on a conventional golf ball, an aerodynamic performance in keeping with the amount of spin provided by the internal construction of the ball can be achieved, enabling the distance traveled by the ball to be improved.

The dimples formed on the surface of the ball have a surface coverage which, while not subject to any particular limitation, is preferably at least about 75% for reasons having to do with the aerodynamic performance.

The dimples may have any of various shapes, such as circular, polygonal, teardrop and oval shapes, without particular limitation. Nor is any particular limitation imposed on the proximity between neighboring dimples. However, because an interval (land width) between neighboring dimples of substantially 0 results in a higher surface coverage, the dimples may be designed in this way. In addition, because the surface coverage can be increased by intermingling dimples of differing sizes on the surface of the ball, the dimples may be designed in this way. Alternatively, it is desirable to use a combination of dimples having contour lengths of from 7 to 20 mm, in addition to which dimples of the same shape but differing depths may be used in admixture. To provide symmetry, the number of dimple types formed on the ball surface may be set to five or more. A specific embodiment for providing symmetry may involve increasing the depth of dimples on or in the vicinity of the line on the ball that corresponds to the parting line between mold halves by from 5 to 50 μm, or decreasing the depth of dimples at both poles of the ball or in the vicinities thereof by from 5 to 50 μm.

Figure 4:
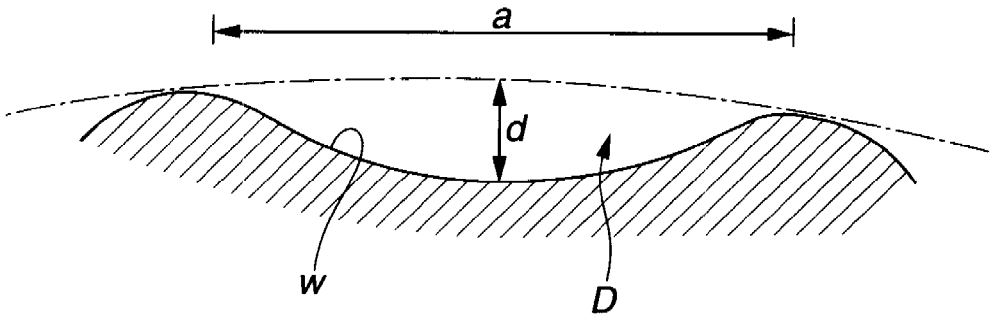
FIG. 4 is an enlarged cross-sectional view of a dimple according to the present invention.

To fully achieve the objects of the invention, the total volume of the dimples, while not subject to any particular limitation, is set in a range of preferably from about 400 $mm^3$ to about 750 $mm^3$, and more preferably from about 450 $mm^3$ to about 700 $mm^3$. The total volume of the dimples is determined by computing the volume of each dimple from the dimple depth, defined for each dimple as the distance from the spherical surface of the ball were it to have no dimples to the bottom of the dimple, and the dimple diameter. That is, referring to FIG. 4, the volume of a single dimple is the volume of the region enclosed by the wall w of the dimple D and the curved surface of land areas on the ball (indicated in the diagram by the dash-dot line), and the total dimple volume refers to the sum of the individual dimple volumes. In the diagram, the dimple diameter is denoted by the reference symbol a, and the dimple depth is denoted by the reference symbol d.

The completed golf ball (golf ball having dimples) has a deflection, when compressed under a final load of 130 kgf from an initial load of 10 kg, of at least about 2.0 mm, preferably at least about 2.5 mm, and more preferably at least about 2.7 mm. The upper limit is not more than about 4.0 mm, preferably not more than about 3.5 mm, and more preferably not more than about 3.4 mm.

As explained above, in the golf ball according to the present invention, the synergistic effects of the core, the intermediate layer and the cover keep the rebound of the golf ball as a whole from decreasing, enabling the ball to travel farther.

EXAMPLES

Examples of the invention and Comparative Examples are given below by way of illustration, and not by way of limitation.

Examples 1 to 3, Comparative Examples 1 to 4

Cores for the respective examples of the invention and comparative examples were produced by blending suitable amounts of an organic peroxide, an antioxidant, zinc oxide, zinc acrylate and an organosulfur compound (diphenylsulfide or the zinc salt of pentachlorothiophenol) in polybutadiene having the trade name BR 730 (available from JSR Corporation) as the base rubber, then vulcanizing the blend under applied heat at 155° C. for 15 minutes. The properties of the resulting cores are shown in Table 2 below.

A single intermediate layer was formed by injection molding one of intermediate layer materials No. 1 to No. 3 described below over the core in the respective examples, following which a cover material common to all the examples was used to form the cover layer. During injection-molding of the cover, dimples were formed in a given pattern on the surface of the cover by means of dimple-forming projections within the mold cavity for creating a given arrangement of dimples. Details of the dimples are given in Table 1 and shown in FIGS. 2 and 3.

Intermediate Layer Material No. 1

A resin material composed of HPF2000 (available under this trade name from DuPont), to which has been added 5 wt % of Dynaron 6100P (available under this trade name from JSR Corporation).

Intermediate Layer Material No. 2

Available from DuPont under the trade name HPF AD1035.

Intermediate Layer Material No. 3

Prepared by blending 20 parts by weight of behenic acid, 2.9 parts by weight of calcium hydroxide and 0.3 part by weight of blue pigment with 100 parts by weight of a base resin composed of 85 wt % of Himilan AM7331 (available under this trade name from DuPont-Mitsui Polychemicals) and 15 wt % of Dynaron 6100P (available under this trade name from JSR Corporation).

Cover Material

Prepared by blending 1 part by weight of polyethylene wax (available from Sanyo Chemical Industries under the trade name Sanwax 161-PKH) with a base resin prepared from Himilan 1605, Himilan 1706 and Himilan AM7329 (all available under these tradenames from DuPont-Mitsui Polychemicals) in a weight ratio of 50:25:25.

TABLE 1

| | No. | Number of dimples | Diameter (mm) | Contour length (mm) | Depth (mm) | Volume ($mm^3$) | Total number | Total volume ($mm^3$) | Surface coverage (%) |
|---|---|---|---|---|---|---|---|---|---|
| Dimple I | No. 1 | 12 | 4.60 | 14.5 | 0.27 | 2.205 | 330 | 568 | 81 |
| | No. 2 | 234 | 4.40 | 13.8 | 0.26 | 1.937 | | | |
| | No. 3 | 60 | 3.80 | 11.9 | 0.22 | 1.227 | | | |
| | No. 4 | 12 | 3.50 | 11.0 | 0.20 | 0.934 | | | |
| | No. 5 | 12 | 2.50 | 7.9 | 0.14 | 0.321 | | | |
| Dimple II | No. 1 | 288 | 3.90 | 12.3 | 0.24 | 1.376 | 432 | 508 | 80 |
| | No. 2 | 60 | 3.80 | 11.9 | 0.23 | 1.280 | | | |
| | No. 3 | 12 | 2.90 | 9.1 | 0.18 | 0.566 | | | |
| | No. 4 | 60 | 2.40 | 7.5 | 0.13 | 0.289 | | | |
| | No. 5 | 12 | 3.40 | 10.7 | 0.21 | 0.905 | | | |

Figure 2:
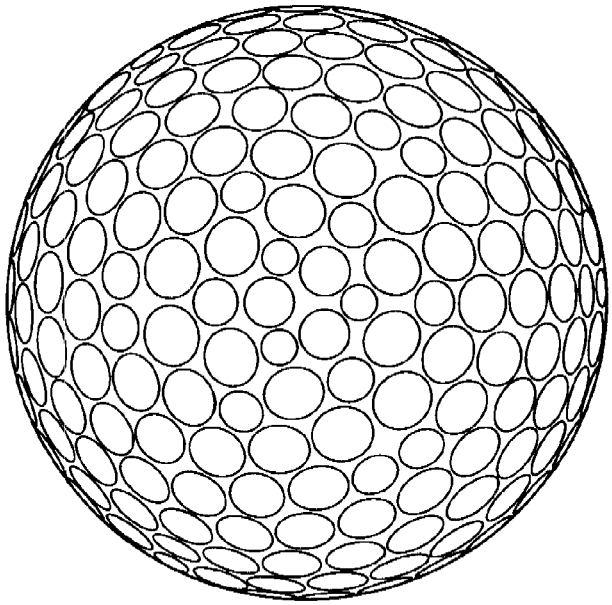
FIG. 2 is a top view of a golf ball showing the arrangement of dimples used in the examples of the invention.
Figure 3:
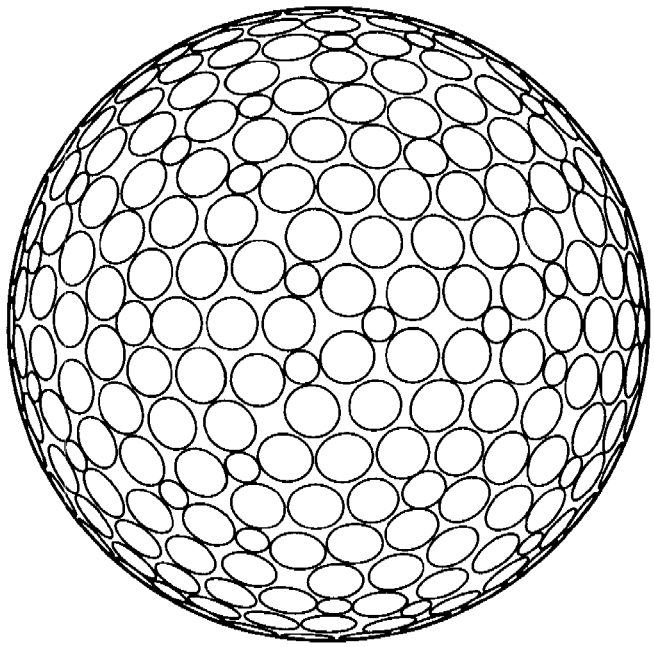
FIG. 3 is a top view of a golf ball showing the arrangement of dimples used in the comparative examples.

Note:
The Dimple I arrangement is shown in FIG. 2, and the Dimple II arrangement is shown in FIG. 3. The dimple volume was computed from the dimple depth, measured from the spherical surface of the ball were it to have no dimples to the bottom of the dimple, and the dimple diameter.

TABLE 2

| | Example | | | Comparative Example | | | |
|---|---|---|---|---|---|---|---|
| | 1 | 2 | 3 | 1 | 2 | 3 | 4 |
| Core | | | | | | | |
| Diameter (mm) | 31.8 | 35 | 35 | 27.6 | 37.3 | 35 | 31.8 |
| Center hardness (JIS-C) | 60 | 60 | 63 | 53 | 60 | 58 | 60 |
| Surface hardness (JIS-C) | 75 | 77 | 79 | 70 | 77 | 74 | 75 |
| Hardness difference (surface − center) | 15 | 17 | 16 | 17 | 17 | 16 | 15 |
| Deflection (mm) A | 4.1 | 3.9 | 3.6 | 4.8 | 3.7 | 4.1 | 4.1 |
| Intermediate layer | | | | | | | |
| Type | No. 1 | No. 1 | No. 2 | No. 1 | No. 1 | No. 3 | No. 1 |
| Gauge (mm) | 4.1 | 2.5 | 2.5 | 6.2 | 1.35 | 2.5 | 4.1 |
| Shore D hardness | 43 | 43 | 38 | 43 | 43 | 50 | 43 |
| Deflection (mm) | 3.5 | 3.6 | 3.4 | 3.5 | 3.5 | 3.6 | 3.5 |
| Cover | | | | | | | |
| Gauge (mm) | 1.35 | 1.35 | 1.35 | 1.35 | 1.35 | 1.35 | 1.35 |
| Shore D hardness | 63 | 63 | 63 | 63 | 63 | 63 | 63 |
| Ball diameter (mm) | 42.7 | 42.7 | 42.7 | 42.7 | 42.7 | 42.7 | 42.7 |
| Ball deflection (mm) B | 3.1 | 3.1 | 3.1 | 3.1 | 3.1 | 3.1 | 3.1 |
| A − B | 1 | 0.8 | 0.5 | 1.7 | 0.6 | 1 | 1 |
| (Intermediate layer thickness) + (cover thickness) | 5.45 | 3.85 | 3.85 | 7.55 | 2.7 | 3.85 | 5.45 |
| Dimples | I | I | I | I | I | I | II |
| Spin on shots with W#1 (rpm) | 2550 | 2600 | 2620 | 2650 | 2650 | 2850 | 2550 |
| Total distance (m) | 235 | 234 | 234 | 233 | 233 | 232 | 232 |

(1) Deflection of Core and Sphere

The core or sphere was placed on a hard plate, and the deflection (mm) when compressed under a final load of 1,275 N (130 kgf) from an initial load of 98 N (10 kgf) was measured.

(2) Center Hardness and Surface Hardness of Core

The center hardness of the core was determined by cutting a core sphere in half, placing the indenter at the center of the cut face, and measuring the JIS-C hardness (in accordance with JIS-K6301).

To determine the surface hardness of the core, the durometer indenter was set substantially perpendicular to the spherical surface of the core, and JIS-C hardness measurements (in accordance with JIS-K6301) were taken at two randomly selected points on the core surface. The average of the two measurements was used as the core surface hardness.

(3) Hardness of Intermediate Layer Material

The Shore D hardness was measured in accordance with ASTM D-2240.

(4) Hardness of Cover Material

The same measurement method was used as in (3) above.

(5) Flight Performance

The carry and total distance of the ball when hit at a head speed (HS) of 40 m/s with a club (X-Drive, manufactured by Bridgestone Sports Co., Ltd.; loft angle, 10.5°) mounted on a swing robot were measured. The results were rated according to the criteria shown below. The spin rate was the value measured for the ball immediately following impact, using an apparatus for measuring initial conditions.

Based on the results in Table 2, the balls obtained in the comparative examples were inferior in the following ways to the balls obtained in the examples of the invention.

In Comparative Example 1, the intermediate layer was too thick, making it impossible to reduce the spin rate of the ball and thus resulting in a shorter distance of travel.

In Comparative Example 2, the combined thickness of the intermediate layer and the cover was smaller than the specified range, making it impossible to reduce the spin rate of the ball and thus resulting in a shorter distance of travel.

In Comparative Example 3, because the sphere (core+intermediate layer) had too low a resilience, the intermediate layer was harder than the specified range, making it impossible to reduce the spin rate of the ball and thus resulting in a shorter distance of travel.

In Comparative Example 4, because the ball lacked the prescribed dimple construction, the desired aerodynamic properties were not obtained, resulting a shorter distance of travel.

The invention claimed is:

1. A golf ball comprising a core, a cover having a plurality of dimples on an outside surface thereof, and an intermediate layer disposed between the core and the cover, wherein the intermediate layer is formed of a material composed primarily of a heated mixture of:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) from about 15 to about 150 parts by weight of a fatty acid and/or fatty acid derivative having a molecular weight of from 228 to 1500; and (d) from about 0.1 to about 17 parts by weight of a basic inorganic metal compound capable of neutralizing unneutralized acid groups in the base resin and component (c);

wherein 100 mol % of the acid groups in the base resin and component (c) are neutralized;

the intermediate layer has a Shore D hardness of less than about 50 and a thickness of at least about 1.7 mm but not more than about 6.0 mm; the cover and the intermediate layer have a difference in Shore D hardness therebetween (cover Shore D hardness—intermediate layer Shore D hardness) of from about 13 to about 35; the cover and the intermediate layer have a combined thickness greater than about 3 mm; and the ball as a whole has a deflection, when compressed under a final load of 130 kgf from an initial load of 10 kgf, of at least about 2.0 mm but not more than about 4.0 mm, and the sphere composed of the core encased by the intermediate layer has a deflection of about 2.5 to 3.6 mm when compressed under a final load of 130 kgf from an initial load of 10 kgf.

2. The golf ball of claim 1, wherein the number of dimples is from about 250 to about 350, and the dimples have a total volume of from about 400 $mm^3$ to about 750 $mm^3$.

3. The golf ball of claim 1, wherein the core has a deflection of from about 3.0 to 5.0 mm when compressed under a final load of 130 kgf from an initial load of 10 kgf and a surface hardness of a JIS-C hardness value of at least about 60 but not more than about 85.

4. The golf ball of claim 1, wherein the cover and the intermediate layer have a difference in Shore D hardness therebetween (cover Shore D hardness—intermediate layer Shore D hardness) of from about 13 to 35.

5. The golf ball of claim 1, wherein the cover and the intermediate layer have a combined thickness of at least about 3.5 mm.

6. The golf ball of claim 1, wherein the amount of the component (c) is at least about 81 parts by weight per 100 parts by weight of the resin component.

7. The golf ball of claim 1, wherein the thickness of the intermediate layer is at least 4.1 mm but not more than about 6.0 mm.

8. The golf ball of claim 1, wherein the core has a JIS-C surface hardness value of from 60 to 85.

9. The golf ball of claim 1, wherein the core has a JIS-C surface hardness value of from 70 to 80.

10. The golf ball of claim 1, wherein the core has a JIS-C center hardness value of from 50 to 65.

11. The golf ball of claim 1, wherein the core has a JIS-C center hardness value of from 55 to 62.

12. A golf ball comprising a core, a cover having a plurality of dimples on an outside surface thereof, and an intermediate layer disposed between the core and the cover, wherein the intermediate layer is formed of a material composed primarily of a heated mixture of:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) from about 15 to about 150 parts by weight of a fatty acid and/or fatty acid derivative having a molecular weight of from 228 to 1500; and (d) from about 0.1 to about 17 parts by weight of a basic inorganic metal compound capable of neutralizing unneutralized acid groups in the base resin and component (c);

wherein 100 mol % of the acid groups in the base resin and component (c) are neutralized;

the intermediate layer has a Shore D hardness of less than about 50 and a thickness of at least 4.1 mm but not more than about 6.0 mm; the cover and the intermediate layer have a difference in Shore D hardness therebetween (cover Shore D hardness—intermediate layer Shore D hardness) of from about 13 to about 35; the cover and the intermediate layer have a combined thickness of at least about 4.4 mm; and the ball as a whole has a deflection, when compressed under a final load of 130 kgf from an initial load of 10 kgf, of at least about 2.0 mm but not more than about 4.0 mm.

13. The golf ball of claim 12, wherein the number of dimples is from about 250 to about 350, and the dimples have a total volume of from about 400 $mm^3$ to about 750 $mm^3$.

14. The golf ball of claim 12, wherein the core has a deflection of from about 3.0 to 5.0 mm when compressed under a final load of 130 kgf from an initial load of 10 kgf and a surface hardness of a JIS-C hardness value of at least about 60 but not more than about 85.

15. The golf ball of claim 12, wherein the cover and the intermediate layer have a difference in Shore D hardness therebetween (cover Shore D hardness—intermediate layer Shore D hardness) of from about 13 to 35.

16. The golf ball of claim 12, wherein the cover and the intermediate layer have a combined thickness of at least about 4.8 mm.

17. The golf ball of claim 12, wherein the amount of the component (c) is at least about 81 parts by weight per 100 parts by weight of the resin component.

18. The golf ball of claim 12, wherein the core has a JIS-C surface hardness value of from 60 to 85.

19. The golf ball of claim 12, wherein the core has a JIS-C surface hardness value of from 70 to 80.

20. The golf ball of claim 12, wherein the core has a JIS-C center hardness value of from 50 to 65.

21. The golf ball of claim 12, wherein the core has a JIS-C center hardness value of from 55 to 62.

* * * * *